US011287839B2

(12) United States Patent
Manohar et al.

(10) Patent No.: US 11,287,839 B2
(45) Date of Patent: Mar. 29, 2022

(54) DUAL LOOP LDO VOLTAGE REGULATOR

(71) Applicant: Apple Inc., Cupertino, CA (US)

(72) Inventors: Sujan K. Manohar, Austin, TX (US); Jay B. Fletcher, Sunnyvale, CA (US); Nathan F. Hanagami, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/583,008

(22) Filed: Sep. 25, 2019

(65) Prior Publication Data

US 2021/0089068 A1 Mar. 25, 2021

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ... G05F 1/575; G05F 1/59; G05F 1/10; G05F 1/46; G05F 1/461; G05F 1/56; G05F 1/562; G05F 1/565; G05F 1/569; G05F 1/595; G05F 1/466; G05F 1/61; G05F 1/618; G05F 1/571; G05F 1/573
See application file for complete search history.

(56) References Cited

U.S. PATENT DOCUMENTS 5,867,015 A * 2/1999 Corsi ..... G05F 3/242 323/316
6,285,246 B1 * 9/2001 Basu ..... G05F 1/575 323/316
6,525,515 B1 * 2/2003 Ngo ..... G05F 1/573 323/274
8,344,713 B2 * 1/2013 Shrivas ..... G05F 1/575 323/273
9,377,798 B2 6/2016 Bhattad
9,454,166 B2 * 9/2016 Liu ..... G05F 1/59
9,588,541 B1 3/2017 Ho et al.
(Continued)

FOREIGN PATENT DOCUMENTS

CN 107688366 A 2/2018
EP 3018551 A1 5/2016

OTHER PUBLICATIONS

International Search Report and Written Opinion in PCT Appl. No PCT/US2020/049138 dated Nov. 25, 2020, 14 pages.

*Primary Examiner* — Gustavo A Rosario-Benitez
(74) *Attorney, Agent, or Firm* — Kowert, Hood, Munyon, Rankin & Goetzel, P.C.

(57) ABSTRACT

A dual loop LDO voltage regulator is disclosed. The voltage regulator circuit includes a first current mirror having first and second transistors having source terminals coupled to an input voltage node. The circuit further includes a second current mirror having third and fourth transistors, wherein drain terminals of the third and fourth transistors are coupled to drain terminals of the first and second transistors, respectively. A feedback circuit is coupled between source terminals of the third and fourth transistors, and is configured to generate a feedback signal based on a reference voltage and an output voltage present on the source terminal of the fourth transistor. The first and second current mirrors form a first control loop, and wherein the first and second current mirrors and the feedback circuit form a second control loop.

20 Claims, 4 Drawing Sheets

(56) References Cited

U.S. PATENT DOCUMENTS

| | | | | |
|---|---|---|---|---|
| 9,946,283 | B1 | 4/2018 | Yung et al. | |
| 9,989,981 | B1 | 6/2018 | Du et al. | |
| 10,146,240 | B1 * | 12/2018 | Wang | G05F 1/575 |
| 10,156,861 | B2 | 12/2018 | Coimbra et al. | |
| 10,234,883 | B1 | 3/2019 | Du et al. | |
| 10,345,838 | B1 | 7/2019 | Karadi et al. | |
| 2008/0165465 | A1 * | 7/2008 | Rallabandi | G05F 1/573 361/93.9 |
| 2009/0033298 | A1 * | 2/2009 | Kleveland | G05F 1/575 323/271 |
| 2012/0223688 | A1 * | 9/2012 | Iriarte | G05F 1/56 323/280 |
| 2013/0119954 | A1 * | 5/2013 | Lo | G05F 1/10 323/280 |
| 2014/0355161 | A1 * | 12/2014 | Torres | H02H 9/02 361/93.9 |
| 2015/0002110 | A1 * | 1/2015 | Singh | G05F 1/468 323/265 |
| 2015/0061622 | A1 * | 3/2015 | Bhattad | G05F 1/573 323/280 |
| 2015/0234404 | A1 * | 8/2015 | Agarwal | G05F 1/575 323/273 |
| 2015/0301540 | A1 * | 10/2015 | Shukla | G05F 1/56 327/540 |
| 2016/0187902 | A1 * | 6/2016 | Zeng | G05F 1/575 323/280 |
| 2017/0060166 | A1 * | 3/2017 | Shukla | G05F 3/267 |
| 2017/0242448 | A1 * | 8/2017 | Wong | G05F 1/468 |
| 2018/0090944 | A1 | 3/2018 | Reddiconto et al. | |
| 2018/0138898 | A1 * | 5/2018 | Nallamothu | H03K 17/687 |

* cited by examiner

DUAL LOOP LDO VOLTAGE REGULATOR

BACKGROUND

Technical Field

This disclosure is directed to electronic circuits, and more particularly, to voltage regulator circuits.

Description of the Related Art

Voltage regulators are commonly used in a wide variety of circuits in order to provide a low ripple regulated desired voltage to analog/digital circuits. To this end, a wide variety of voltage regulator circuits are available to suit various applications. Linear voltage regulators are used in a number of different applications in which the available supply voltages exceed an appropriate value for the circuitry to be powered. Accordingly, linear voltage regulators may output a voltage that is less than the received supply voltage.

One type of linear voltage regulator is the low dropout (LDO) regulator. An LDO voltage regulator may operate to provide an output voltage that is very close to the received supply voltage. Furthermore, LDO voltage regulators may be relatively simple in design in comparison with some other types of voltage regulators, such as buck or boost converters which require switching among multiple voltage regulation phases.

SUMMARY

A dual loop LDO voltage regulator is disclosed. In one embodiment, a voltage regulator circuit includes a first current mirror having first and second transistors having source terminals coupled to an input voltage node. The circuit further includes a second current mirror having third and fourth transistors, wherein drain terminals of the third and fourth transistors are coupled to drain terminals of the first and second transistors, respectively. A feedback circuit is coupled between source terminals of the third and fourth transistors, and is configured to generate a feedback signal based on a reference voltage and an output voltage present on the source terminal of the fourth transistor. The first and second current mirrors form a first control loop, and wherein the first and second current mirrors and the feedback circuit form a second control loop.

In various embodiments, the first control loop provides a faster transient response time than the second control loop. For example, responsive to a drop in voltage on an output node (coupled to the second current mirror), the first control loop may respond to rapidly deliver additional current in order to minimize any voltage droop in response to load current demand. The second control loop, which includes both current mirrors and the feedback circuit, may provide longer term stability of the output voltage.

BRIEF DESCRIPTION OF THE DRAWINGS

The following detailed description makes reference to the accompanying drawings, which are now briefly described.

Figure 1:
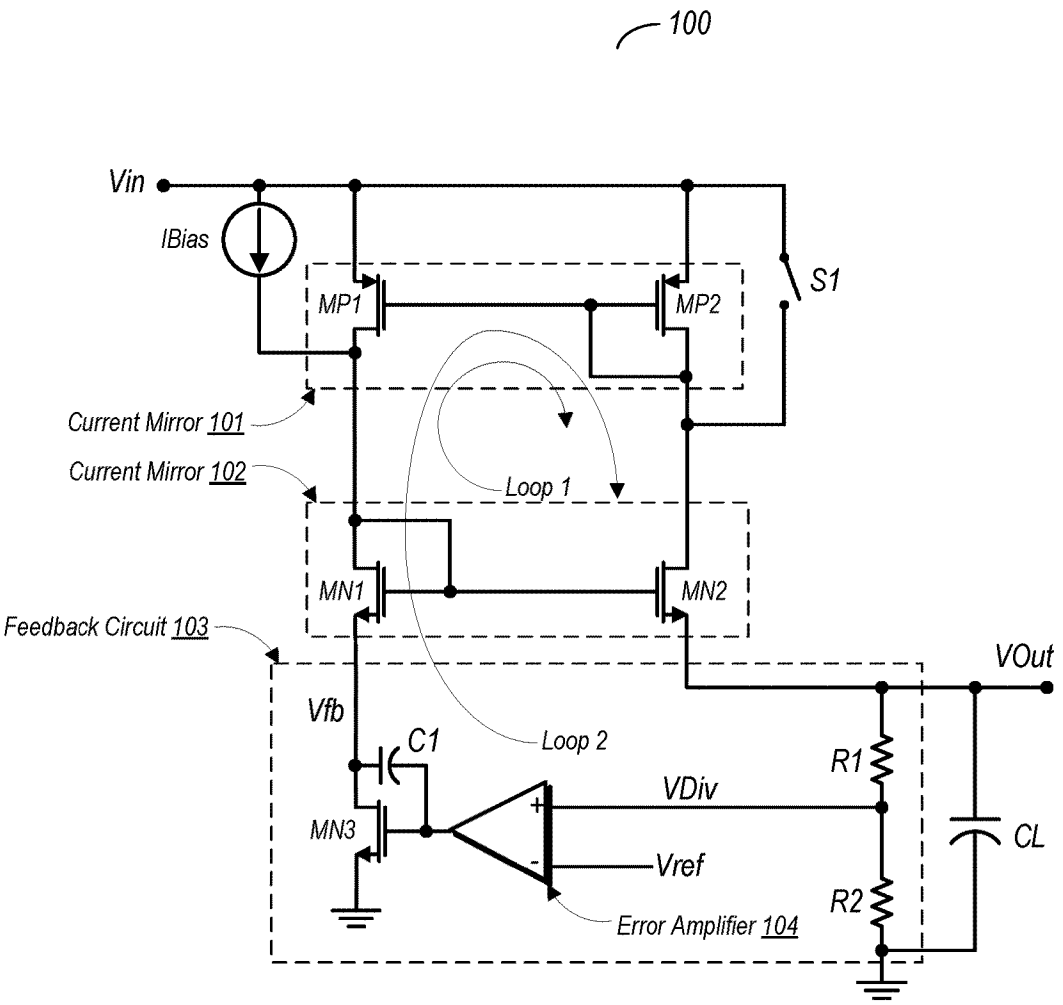
FIG. 1 is a schematic diagram of one embodiment of a voltage regulator circuit.

Although the embodiments disclosed herein are susceptible to various modifications and alternative forms, specific embodiments are shown by way of example in the drawings and are described herein in detail. It should be understood, however, that drawings and detailed description thereto are not intended to limit the scope of the claims to the particular forms disclosed. On the contrary, this application is intended to cover all modifications, equivalents and alternatives falling within the spirit and scope of the disclosure of the present application as defined by the appended claims.

This disclosure includes references to "one embodiment," "a particular embodiment," "some embodiments," "various embodiments," or "an embodiment." The appearances of the phrases "in one embodiment," "in a particular embodiment," "in some embodiments," "in various embodiments," or "in an embodiment" do not necessarily refer to the same embodiment. Particular features, structures, or characteristics may be combined in any suitable manner consistent with this disclosure.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical, such as an electronic circuit). More specifically, this formulation is used to indicate that this structure is arranged to perform the one or more tasks during operation. A structure can be said to be "configured to" perform some task even if the structure is not currently, being operated, A "credit distribution circuit configured to distribute credits to a plurality of processor cores" is intended to cover, for example, an integrated circuit that has circuitry that performs this function during operation, even if the integrated circuit in question is not currently being used (e.g., a power supply is not connected to it). Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed FPGA, for example, would not be considered to be "configured to" perform some specific function, although it may be "configurable to" perform that function after programming.

Reciting in the appended claims that a structure is "configured to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke Section 112(f) during prosecution, it will recite claim elements using the "means for" [performing a function] construct.

As used herein, the term "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

As used herein, the phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

As used herein, the terms "first," "second," etc. are used as labels for nouns that they precede, and do not imply any type of ordering (e.g., spatial, temporal, logical, etc.), unless stated otherwise. For example, in a register file having eight registers, the terms "first register" and "second register" can be used to refer to any two of the eight registers, and not, for example, just logical registers 0 and 1.

When used in the claims, the term "or" is used as an inclusive or and not as an exclusive or. For example, the phrase "at least one of x, y, or z" means any one of x, y, and z, as well as any combination thereof.

In the following description, numerous specific details are set forth to provide a thorough understanding of the disclosed embodiments. One having ordinary skill in the art, however, should recognize that aspects of disclosed embodiments might be practiced without these specific details. In some instances, well-known circuits, structures, signals, computer program instruction, and techniques have not been shown in detail to avoid obscuring the disclosed embodiments.

DETAILED DESCRIPTION OF EMBODIMENTS

Various embodiments of an LDO voltage regulator circuit are disclosed. A voltage regulator circuit as disclosed herein includes first and second control loops (or alternatively, gain loops). The first control loop may provide a fast response to transients occurring on an output node of the voltage regulator (e.g., a sudden change in current demand). The first control loop responds faster than the second control loop. The second control loop maintains the longer-term average of the output voltage of the voltage regulator based on feedback generated therein.

The first control loop may be implemented using first and second current mirrors. The first current mirror may be coupled to receive an input (or supply) voltage for the voltage regulator circuit. The second current mirror may include at least one transistor implemented in a source follower configuration and therefore coupled to the output node upon which the output voltage of the regulator is provided.

The second control loop may include both the first and second current mirrors, and additionally includes a feedback circuit. The feedback circuit is arranged to generate a feedback voltage based on the output voltage and a reference voltage. The feedback voltage may be provided to a terminal (e.g., a source terminal) of a device in the second current mirror. The effect of the feedback signal passes through the first current mirror and back into the second current mirror. The second control loop helps maintain stability of the voltage regulator output at a desired output voltage. Various embodiments of such a circuit are now discussed in further detail.

FIG. 1 is a schematic diagram of one embodiment of an LDO voltage regulator circuit. In the embodiment shown, voltage regulator 100 includes a first current mirror 101, a second current mirror 102, and a feedback circuit 103. Voltage regulator 100 also includes a bias current source, IBias. An optional switch, S1, is also included in the illustrated embodiment.

Current mirror 101 in this particular embodiment is implemented using two PMOS transistors, MP1 and MP2. As shown here, MP2 is a diode coupled device. The source terminals of both MP1 and MP2 are coupled to the input voltage node, Vin. Current source IBias is coupled between source and drain terminals of MP1 and MN1 respectively and provides a small bias current to keep MN1 active when the load on the voltage regulator is light, or when current demand, as indicated by feedback, is very low. Switch S1, which is optional, may be implemented such that it closes when dropout conditions are reached (e.g., when the difference between the input voltage and the output voltage falls below drop out voltage of the LDO or a minimum level). Although not shown, sensing circuitry may also be included in embodiments that include switch S1 to enable detection of dropout conditions. Switch S1 helps to deliver input supply voltage to output when input supply voltage drops low, thereby eliminating the diode voltage dropout of MP2.

It is noted that in various embodiments, MP1 and MP2 may be matching transistors with respect to one or more dimensions thereof. For example, both of these devices may have the same gate lengths and current density. Moreover, embodiments in which these devices are matching in all dimensions are possible and contemplated.

Current mirror 102 in the embodiment shown includes NMOS transistor MN1 and MN2. Transistor MN1 is a diode-coupled device in this embodiment. The output node of voltage regulator 100 (e.g., the node upon which the regulated output voltage is provided) is coupled to the source of MN2. The drain terminals of both MN1 and MN2 are coupled to drain terminals of MP1 and MP2, respectively. Taken together, current mirror 101 and current mirror 102 form a first control loop, Loop 1, the operation of which is discussed in further detail below. As with the devices of current mirror 101, transistors MN1 and MN2 may be matching with respect to one or more dimensions thereof.

Feedback circuit 103 in the embodiment shown includes a voltage divider implemented using matched resistors R1 and R2. Resistors R1 and R2 are coupled in series between the output node, VOut, and a ground node. A load capacitance, shown here as CL, is in parallel with the voltage divider. During operation, a voltage VDiv is generated at the junction of R1 and R2. VDiv is provided to one input of error amplifier 104, which may be implemented as an operational transconductance amplifier. It is noted that embodiments are possible and contemplated in which the output voltage is coupled directly to one of the inputs of error amplifier 104. A reference voltage, Vref, is provided to the other input of error amplifier 104. The reference voltage Vref may be generated using any suitable voltage generation circuit, such as a bandgap circuit designed explicitly for voltage generation. The output of error amplifier 104 is an error signal provided to the gate terminal of MN3 and one terminal of capacitor C1. The feedback voltage, Vfb, is provided on the source terminal of MN1. Collectively, feedback circuit 103, current mirror 101 and current mirror 102 form a second control loop, Loop 2.

The two control loops of the embodiment shown provide different functions. Loop 1 in the embodiment shown provides fast transient response, and generally, responds to changing load conditions (e.g., transients) faster than Loop 2. Meanwhile, Loop 2 provides slower feedback for stable operation of the regulator 100, and sets the desired output voltage based on the reference voltage Vref.

During operation, when the output voltage Vout falls due to an increase in load current demand, the gate-source voltage of MN2 increases correspondingly. This increases the current through MN2, and thus through MP2. This in turn causes an increase in current through MP1, which is a mirrored current from MP2. The increase in current through MP1 thus passes through MN1, and this current is mirrored back to MN2. Thus, the first control loop provides a fast gain path that enables a fast response to transient conditions on the output node of voltage regulator 100. The process described herein also works in reverse responsive to a rapid increase in Vout corresponding to a sudden drop in current demand. Generally speaking, transistor MN2 senses the output voltage and Loop 1 causes its gate terminal to increase or decrease to provide more or less current, respectively. The arrangement shown here thus allows MN2 to see changes on both its source and gate terminals with respect to changes in the output voltage, thereby ensuring a fast transient gate-source voltage swing. This in turn aids in the fast load transient response of voltage regulator 100.

Operation of the second control loop includes generating a feedback voltage, Vfb. Changes to the output voltage, VOut, are reflected in the voltage VDiv that is generated by the voltage divider implemented using R1 and R2. Error amplifier 103 effectively compares VDiv with the reference voltage Vref, and uses the corresponding output error signal to drive the gate of MN3. When VOut increases, VDiv increases, and as a result, the gate-source voltage of MN3 increases. This pulls the source and thereby also the gate of MN3 to a lower voltage. This in turn reduces the gate voltage of MN2 and thus the gate-source voltage of MN2. As a result, the current through MN2 is reduced to compensate for the initial increase in VOut. This process works in reverse when VOut decreases. Generally speaking, the second control loop may make longer term adjustments to the output current of voltage regulator 100 responsive to longer term increases in load current demand.

Figure 2:
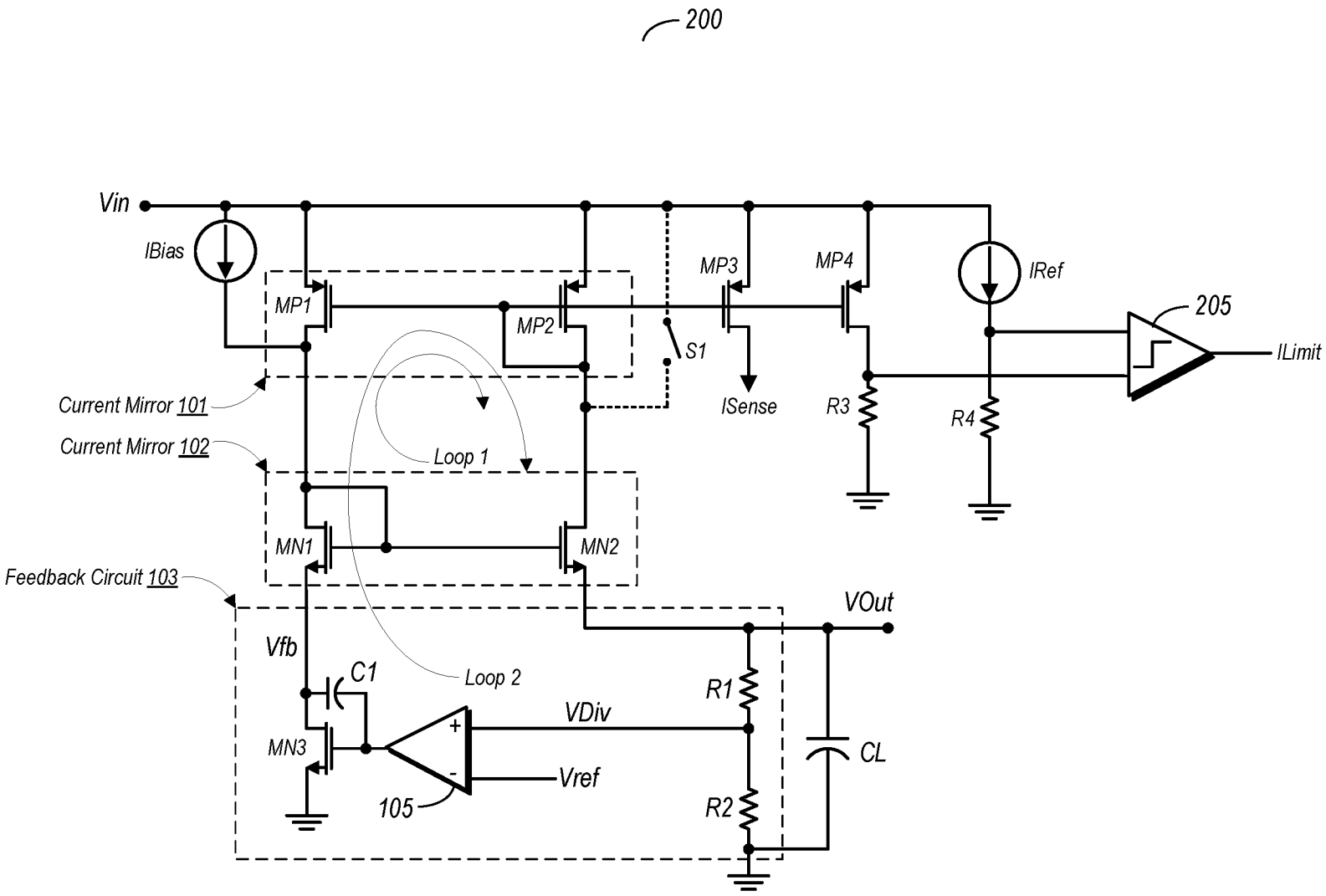
FIG. 2 is a schematic diagram illustrating implementation of one embodiment of a voltage regulator circuit with current sensing and current limiting schemes.

FIG. 2 is a schematic diagram illustrating implementation of one embodiment of a voltage regulator circuit with current sensing and limiting circuit. In the embodiment shown, circuit 200 includes all of the elements of voltage regulator 100, with the exception of switch S1, although embodiments having this switch are possible and contemplated. Similarly, operation of the voltage regulator portion of circuit 200 is the same as that described above with respect to voltage regulator 100, again save for switch S1 which is not implemented here. Switch S1 is intended to turn on and help to deliver input supply voltage to output when input supply voltage drops low, thereby eliminating the diode voltage dropout of MP2.

In the embodiment shown, transistor MP3 is implemented as part of a current sensing circuit. The current through MP3 is mirrored from MP2, and is thus a copy of the output current provided by voltage regulator 100. In some embodiment, MP3 may also be matched to MP1 and MP2 with respect to one or more dimensions to enable more accurate sensing of the current. The current through MP3 may be provided, as ISense, to another circuit having the capability of determining the amount of current flowing that circuit. Accordingly, current demanded by a load circuit coupled to the voltage regulator may be sensed and thus monitored.

Transistor MP4 is also arranged to mirror the currents through MP2. Resistor R3 is coupled to the drain terminal of MP4 in order to generate a voltage (it is noted that MP4 may also be matched with MP2 as described above for other devices). This voltage is provided as one input to comparator 205. Another reference voltage is generated at the junction of current source IRef and resistor R4. Current source IRef provides a reference current for a basis of comparison. Based on a comparison of the two voltages input into comparator 205, a determination can be made as to whether the output current provided by the voltage regulator portion of circuit 200 has exceeded a prescribed limit. If the limit is exceeded, comparator 205 asserts the ILimit signal. Other circuitry (not shown here) may receive the ILimit signal and take appropriate action to limit the output current. For example, a power management circuit may disable a portion of the load coupled to the voltage regulator to reduce current demand, thereby limiting the output current provided.

Figure 3:
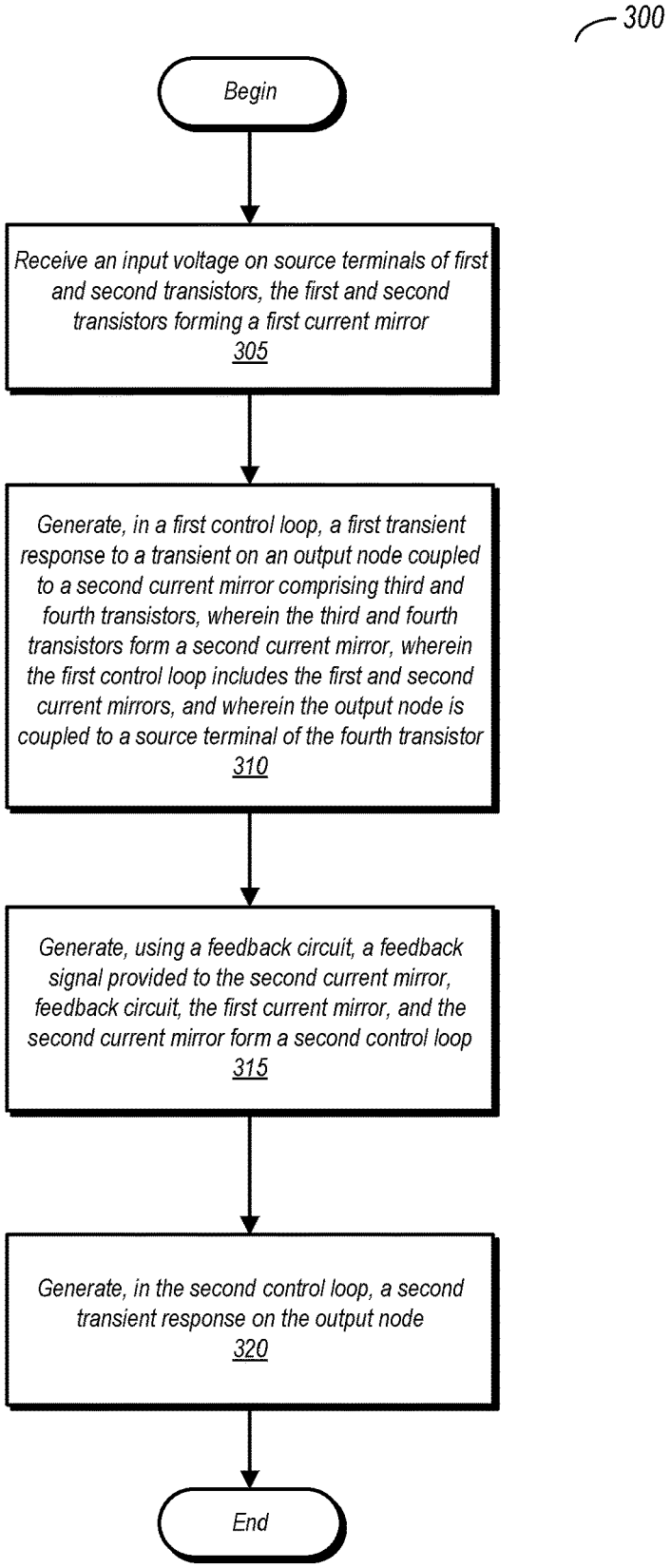
FIG. 3 is a flow diagram illustrating one embodiment of a method for operating a voltage regulator circuit.

FIG. 3 is a flow diagram illustrating one embodiment of a method for operating a voltage regulator circuit. Method 300 as disclosed herein may be utilized with various embodiments of the circuitry discussed above in FIGS. 1 and 2. Voltage regulator embodiments that are capable of carrying out Method 300 may also fall within the scope of this disclosure.

Method 300 begins with receiving an input voltage on source terminals of first and second transistors, the first and second transistors forming a first current mirror (block 305). The method further includes generating, in a first control loop, a first transient response to a transient on an output node coupled to a second current mirror comprising third and fourth transistors, wherein the third and fourth transistors form a second current mirror, wherein the first control loop includes the first and second current mirrors, and wherein the output node is coupled to a source terminal of the fourth transistor (block 310). Thereafter, the method further includes generating, using a feedback circuit, a feedback signal provided to the second current mirror, wherein the feedback circuit, the first current mirror, and the second current mirror form a second control loop (block 315). In addition to the first transient response, the method includes generating, in the second control loop, a second transient response on the output node (block 320).

In various embodiments, generating the feedback signal comprises generating an error signal based on a voltage provided from a voltage divider circuit to a first input of an error amplifier, and a reference voltage provided to a second input of the error amplifier. In various embodiments of the voltage regulator circuit disclosed herein, the first transient response is generated faster than the second transient response. In some embodiment, a switch provides a bypass path between source and drain terminals of the second transistor responsive to a dropout condition. The method may also includes providing a bias current between source and drain terminals of the first transistor.

Figure 4:
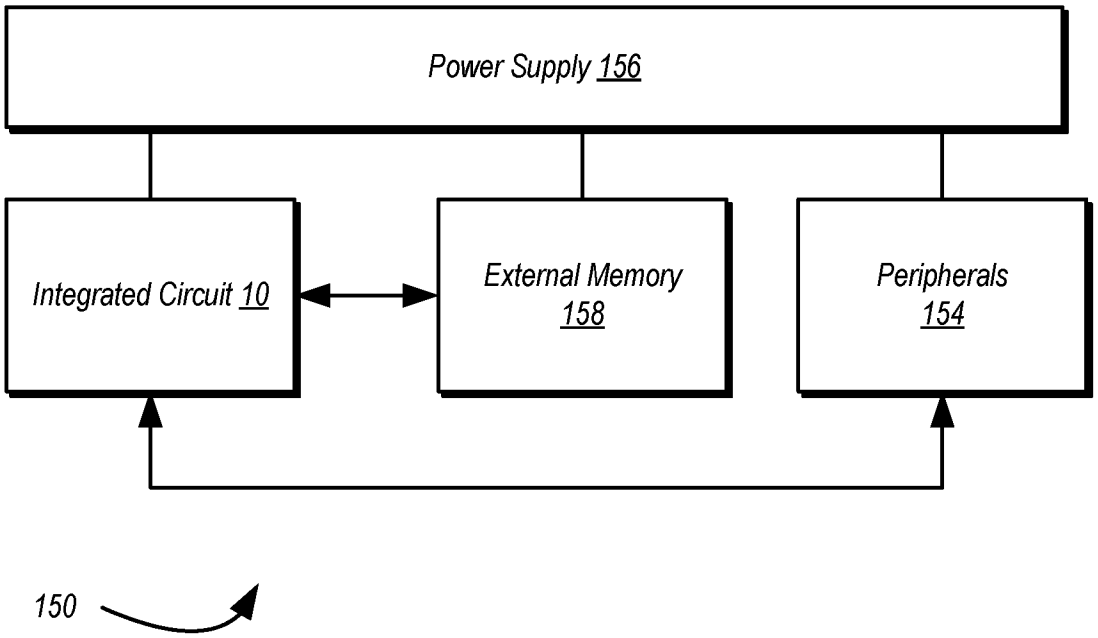
FIG. 4 is a block diagram of one embodiment of an example system.

Turning next to FIG. 4, a block diagram of one embodiment of a system 150 is shown. In the illustrated embodiment, the system 150 includes at least one instance of an integrated circuit 10 coupled to external memory 158. The integrated circuit 10 may include a memory controller that is coupled to the external memory 158. The integrated circuit 10 is coupled to one or more peripherals 154 and the external memory 158. A power supply 156 is also provided which supplies the supply voltages to the integrated circuit 10 as well as one or more supply voltages to the memory 158 and/or the peripherals 154. In some embodiments, more than one instance of the integrated circuit 10 may be included (and more than one external memory 158 may be included as well).

The peripherals 154 may include any desired circuitry, depending on the type of system 150. For example, in one embodiment, the system 150 may be a mobile device (e.g. personal digital assistant (PDA), smart phone, etc.) and the peripherals 154 may include devices for various types of wireless communication, such as WiFi, Bluetooth, cellular, global positioning system, etc. The peripherals 154 may also include additional storage, including RAM storage, solid-state storage, or disk storage. The peripherals 154 may include user interface devices such as a display screen, including touch display screens or multitouch display screens, keyboard or other input devices, microphones, speakers, etc. In other embodiments, the system 150 may be any type of computing system (e.g. desktop personal computer, laptop, workstation, tablet, etc.).

In various embodiments, integrated circuit 10 and/or peripherals 154 may include implementations of the voltage regulator circuit discussed above in reference to FIGS. 1 and 2.

The external memory 158 may include any type of memory. For example, the external memory 158 may be SRAM, dynamic RAM (DRAM) such as synchronous DRAM (SDRAM), double data rate (DDR, DDR2, DDR3, LPDDR1, LPDDR2, etc.) SDRAM, RAMBUS DRAM, etc. The external memory 158 may include one or more memory modules to which the memory devices are mounted, such as single inline memory modules (SIMMs), dual inline memory modules (DIMMs), etc.

Numerous variations and modifications will become apparent to those skilled in the art once the above disclosure is fully appreciated. It is intended that the following claims be interpreted to embrace all such variations and modifications.

What is claimed is:

1. A circuit comprising:

a first current mirror having first and second transistors including respective source terminals electrically coupled to receive an input voltage from an input voltage node, wherein the first and second transistors are PMOS transistors;

a second current mirror having third and fourth transistors, wherein respective drain terminals of the third and fourth transistors are electrically coupled to drain terminals of the first and second transistors, respectively, wherein the third and fourth transistors are NMOS transistors;

a feedback circuit including a voltage divider having first and second resistors coupled in series between the source terminal of the fourth transistor and a ground node, an error amplifier having a first input coupled to a junction of the first and second resistors, and a second input coupled to receive a reference voltage, and a fifth transistor having a gate terminal coupled to an output of the error amplifier and a drain terminal electrically coupled to a source terminal of the third transistor, wherein the feedback circuit is configured to generate a feedback signal based on a reference voltage and an output voltage present on an output voltage node electrically coupled to the source terminal of the fourth transistor; and a bypass switch coupled in parallel with the second transistor, wherein the bypass switch is configured to be activated responsive to detection of a dropout condition;

wherein the first and second current mirrors form a first control loop, and wherein the first and second current mirrors and the feedback circuit form a second control loop.

2. The circuit of in claim 1, wherein the first control loop has a faster transient response time with respect to that of the second control loop.

3. The circuit of claim 1, wherein the second and third transistors are diode coupled devices.

4. The circuit of claim 1, further comprising a current source coupled between the source and drain terminals of the first transistor, the current source configured to generate a bias current.

5. The circuit of in claim 1, wherein the first and second transistors are matched in one or more dimensions, and wherein the third and fourth transistor are matched in one or more dimensions.

6. A method comprising:

receiving an input voltage on source terminals of first and second transistors, the first and second transistors being PMOS transistors and forming a first current mirror;

generating, in a first control loop, a first transient response to a transient on an output node coupled to a second current mirror comprising third and fourth transistors, wherein the third and fourth transistors are NMOS transistors that form a second current mirror, wherein drain terminals of the third and fourth transistors are electrically coupled to drain terminals of the first and second transistors, respectively, wherein the first control loop includes the first and second current mirrors, and wherein the output node is electrically coupled to a source terminal of the fourth transistor;

generating, using a feedback circuit, a feedback signal provided to the second current mirror, wherein the feedback circuit, the first current mirror, and the second current mirror form a second control loop, wherein generating the feedback signal comprises:

generating a first voltage using a voltage divider having first and second resistors coupled in series between the source terminal of the fourth transistor and a ground node;

providing the first voltage to a first input of an error amplifier;

providing a reference voltage to a second input of the error amplifier;

generating an error signal using the amplifier; and providing the error signal to a fifth transistor having a gate terminal coupled to an output of the error amplifier and a drain terminal electrically coupled to a source terminal of the third transistor;

generating, in the second control loop, a second transient response on the output node; and providing a bypass path between source and drain terminals of the second transistor responsive to a dropout condition.

7. The method of claim 6, wherein the first transient response is generated faster than the second transient response.

8. The method of claim 6, further comprising providing a bias current between source and drain terminals of the first transistor.

9. A circuit comprising:

a first control loop comprising first and second current mirrors, wherein the first current mirror includes first and second transistors, wherein the first and second transistors are PMOS transistor having respective source terminals electrically coupled to receive an input voltage from an input voltage node, and wherein the second current mirror includes third and fourth transistors, wherein the third and fourth transistors are NMOS transistors having drain terminals electrically coupled to drain terminals of the first and second transistors, respectively, and wherein a source terminal of the fourth transistor is coupled to an output voltage node;

a second control loop comprising the first and second current mirrors and a feedback circuit coupled to receive an output voltage from the output voltage node and configured to provide a feedback signal to the second current mirror, wherein the feedback circuit includes a voltage divider having first and second resistors coupled in series between the source terminal of the fourth transistor and a ground node, an error amplifier having a first input coupled to a junction of the first and second resistors, and a second input coupled to receive a reference voltage, and a fifth transistor having a gate terminal coupled to an output of the error amplifier and a drain terminal electrically coupled to a source terminal of the third transistor; and wherein the first control loop is configured to respond to transient conditions faster than the second control loop.

10. The circuit of claim 9, wherein a source terminal of the third transistor is coupled to receive the feedback signal from the feedback circuit.

11. The circuit of claim 9, wherein the first and second transistors are matched in at least one dimension, and wherein the third and fourth transistors are matched in at least one dimension.

12. The circuit of claim 9, wherein the second and third transistors are diode-coupled devices.

13. The circuit of claim 9, further comprising a bias current source coupled between source and drain terminals of the first transistor.

14. The circuit of claim 1, further comprising a current sensing and limiting circuit coupled to the first current mirror, wherein the current sensing and limiting circuit is configured to assert an indication in response to detecting that an output current has exceeded a reference current.

15. The method of claim 6, further comprising asserting an indication in response to an output current exceeding a reference current.

16. The circuit of claim 9, further comprising a bypass switch coupled in parallel with the second transistor, wherein the bypass switch is configured to be activated when a difference between the input voltage and the output voltage falls below a dropout voltage.

17. The circuit of claim 14, wherein the current sensing and limiting circuit includes:

a sixth transistor configured to mirror a current through the first current mirror;

a seventh transistor configured to mirror the current through the first current mirror; and a resistor coupled to the seventh transistor and configured to generate a comparison voltage based on a current through the seventh transistor.

18. The circuit of claim 17, wherein the current sensing and limiting circuit further includes:

a reference voltage generating circuit comprising a current source configured to generate the reference current and a resistor and configured to generate a reference voltage corresponding to a current limit; and a comparator configured to compare the reference voltage to the comparison voltage and further configured to assert the indication in response to determining that the comparison voltage is greater than the reference voltage.

19. The method of claim 15, wherein asserting the indication comprises a comparator determining that a comparison voltage is greater than a reference voltage, wherein the comparison voltage corresponds to the output current and wherein the reference voltage corresponds to the reference current.

20. The circuit of claim 9, further comprising a current sensing and limiting circuit, wherein the current sensing and limiting circuit includes:

a sixth transistor configured to mirror a current through the first current mirror;

a seventh transistor configured to mirror the current through the first current mirror;

a resistor coupled to the seventh transistor and configured to generate a comparison voltage based on a current through the seventh transistor;

a reference voltage generating circuit comprising a current source configured to generate the reference current and a resistor and configured to generate a reference voltage corresponding to a current limit; and a comparator configured to compare the reference voltage to the comparison voltage and further configured to assert an indication in response to determining that the comparison voltage is greater than the reference voltage.

* * * * *